US010199164B2

(12) United States Patent
Hofer

(10) Patent No.: US 10,199,164 B2
(45) Date of Patent: Feb. 5, 2019

(54) DEVICE AND METHOD FOR WINDING TOROIDAL CORES WITHOUT USING A MAGAZINE

(71) Applicant: RUFF GMBH, Grafing b. München (DE)

(72) Inventor: Alois Hofer, Niederwaldkirchen (AT)

(73) Assignee: RUFF GMBH, Grafing Bei Munich (DE)

( * ) Notice: Subject to any disclaimer, the term of this patent is extended or adjusted under 35 U.S.C. 154(b) by 188 days.

(21) Appl. No.: 15/316,748

(22) PCT Filed: Apr. 27, 2015

(86) PCT No.: PCT/EP2015/059101
§ 371 (c)(1),
(2) Date: Dec. 6, 2016

(87) PCT Pub. No.: WO2015/185288
PCT Pub. Date: Dec. 10, 2015

(65) Prior Publication Data

US 2018/0090270 A1 Mar. 29, 2018

(30) Foreign Application Priority Data

Jun. 6, 2014 (EP) ..... 14171601

(51) Int. Cl.
*H01F 41/00* (2006.01)
*H01F 41/08* (2006.01)
*H01F 41/094* (2016.01)

(52) U.S. Cl.
CPC ..... *H01F 41/08* (2013.01); *H01F 41/094* (2016.01)

(58) Field of Classification Search
CPC ..... H01F 41/08; H01F 41/094
See application file for complete search history.

(56) References Cited

U.S. PATENT DOCUMENTS 4,007,881 A * 2/1977 Haslau ..... H01F 41/08 242/434.4
4,513,920 A * 4/1985 Pedersen ..... H01F 41/08 242/434.2

(Continued)

FOREIGN PATENT DOCUMENTS

DE 101 53 896 A1 5/2003

OTHER PUBLICATIONS

International Preliminary Report on Patentability (IPRP) as issued for PCT Application No. PCT/EP2015/059101, dated Dec. 15, 2016, 13 pages.

(Continued)

*Primary Examiner* — Emmanuel M Marcelo
(74) *Attorney, Agent, or Firm* — Sprinkle IP Law Group

(57) ABSTRACT

The invention relates to a device and to a method for winding toroidal cores without using a magazine, comprising a toroidal-core retainer and comprising elements that are substantially arranged in a wire-guiding plane and that serve to guide and to magazine wire. The device comprises: a first transport roller and a second transport roller, which are arranged in relation to the toroidal-core retainer in such a way that a wire to be magazined on the transport rollers in the wire-guiding plane and to be wound can be guided between the first and the second transport roller through the toroidal core; a wire ejector arranged adjacently to the second transport roller; and a wire tensioner.

18 Claims, 4 Drawing Sheets

(56) References Cited

U.S. PATENT DOCUMENTS

| | | | | |
|---|---|---|---|---|
| 4,637,563 | A * | 1/1987 | Arii | H01F 41/08 242/434.3 |
| 4,884,758 | A * | 12/1989 | Hamkins | H01F 41/08 242/437.1 |
| 2003/0102399 | A1 * | 6/2003 | Veress | H01F 41/08 242/434.7 |
| 2005/0082932 | A1 | 4/2005 | Sweeney et al. | |

OTHER PUBLICATIONS

International Search Report issued for PCT Application No. PCT/EP2015/059101, dated Jun. 19, 2015, 2 pages.

* cited by examiner

DEVICE AND METHOD FOR WINDING TOROIDAL CORES WITHOUT USING A MAGAZINE

CROSS-REFERENCE TO RELATED APPLICATIONS

This is a 35 U.S.C. § 371 national stage of International Patent Application No. PCT/EP2015/059101 filed Apr. 27, 2015, entitled "Device and Method for Winding Toroidal Cores Without Using a Magazine," which claims priority to European Patent Application No. 1417601.9, filed on Jun. 6, 2014, both of which are fully incorporated herein by reference.

The invention relates to a device for winding toroidal cores having a toroidal core retainer and a wire guide without a magazine, as well as a corresponding method for this purpose.

A device for winding toroidal cores having a toroidal core retainer and an annular magazine guided through the toroidal core opening with elements used to guide the wire and magazine the wire is known from DE 101 53 896 A1, for example. The disadvantage of this known device is that the annular magazine for magazining and winding has to be guided through the toroidal core and toroidal cores with a small diameter or tubular cores through which the magazine cannot be guided due to the space requirements of the magazine can therefore not be wound.

Accordingly, the underlying objective of this invention is to propose a winding device and a corresponding winding method which enable toroidal cores with a very small internal diameter and tubular cores to be wound directly. In addition, the device should be of a simple and robust construction and inexpensive to produce.

With a view to achieving this objective, the invention proposes a device for winding toroidal cores without using a magazine, having a toroidal core retainer and elements disposed substantially in a wire guiding plane used for guiding the wire and magazining the wire, and the toroidal core retainer driving the toroidal core to be wound and the elements used to guide the wire and magazine the wire are preferably oriented perpendicular to one another. The elements used to guide the wire and magazine the wire further comprise a first transport roller and a second transport roller which are disposed relative to the toroidal core retainer in such a way that a wire to be magazined and wound on the transport rollers in the wire guiding plane can be guided between the first and second transport rollers through the toroidal core, a wire ejector disposed adjacent to the second transport roller and a wire tensioner. During operation, the wire ejector is configured to move a loop of the wire to be wound, having passed through the toroidal core, sideways out of the wire guiding plane adjacent to the second transport roller. As a result, the wire loop drops down from the second transport roller and bypasses the latter and then runs into the wire tensioner. The wire tensioner is configured to tension the wire loop first of all and then release it again for further winding.

Also proposed with a view to achieving the objective is a method for winding toroidal cores with a wire with the aid of a winding device without using a magazine. Accordingly, the method comprises the following steps: guiding a rotating wire belt preferably comprising a single-piece wire across the first transport roller, through the toroidal core rotating in the toroidal core retainer substantially perpendicular to the wire belt and then across the second transport roller and back to the first transport roller in the wire guiding plane, forming a loop of wire from the wire belt adjacent to the first transport roller, passing through the toroidal core and moving the wire loop out of the wire guiding plane adjacent to the second transport roller by means of the wire ejector, tensioning the wire loop in the wire tensioner and releasing the wire loop by means of the wire tensioner.

As proposed by the invention, therefore, the winding wire is fed in without using a conventional magazine because the wire is magazined directly on the transport rollers. As a result, a closed magazine for guiding and feeding the winding wire can be dispensed with. Given that only the wire to be wound and hence no magazine or such like has to be guided through the toroidal core, toroidal cores having a small internal diameter or tubular cores can also be wound.

Compared with conventional devices for winding toroidal cores (coils) having an annular magazine guided through the toroidal core opening, the device proposed by the invention is of a simple construction because the annular magazine can be dispensed with. Due to the relatively simple construction, the device is also robust and inexpensive to produce. The method proposed by the invention therefore also enables automatic winding of toroidal cores with a small internal diameter or tubular cores or other core geometries that cannot be wound with conventional winding devices using a magazine.

Based on one aspect, the elements used to guide the wire and magazine the wire further comprise at least one auxiliary roller. At least one of the transport or auxiliary rollers is provided in the form of a drive roller or traction roller. The drive roller or traction roller drives the wire to be magazined forward as a so-called wire belt so that it rotates across the first transport roller through the toroidal core and then across the second transport roller. The drive thus also serves as a means of tensioning the wire in the wire tensioner because the wire loop also rotates at the same time and the wire is tensioned and then released again with every rotation. Other auxiliary rollers guide the wire on the path from the second to the first transport roller, preferably on a semi-circular path, so that a sufficiently large quantity of wire can be magazined and a particularly good loop can be formed. In this respect, the transport or auxiliary rollers are configured so that during operation the wire forms a closed wire belt during magazining which can be guided through the toroidal core.

By closed wire belt is meant that during the magazining operation, a wire to be wound is preferably wound onto the rollers in several mutually adjacent wire turns.

Based on one aspect, the wire belt is magazined from a wire supply onto the rollers of the device by winding a wire of a predefined length onto the rollers, for example.

Based on another aspect, therefore, at the start of the actual process of winding onto the toroidal core, one end of the wire magazined as a wire belt and guided through the toroidal core is secured so that the wire can be wound around the toroidal core.

Based on another aspect, the wire tensioner comprises a pre-tensioned, gap-forming wedge. Accordingly, the wire tensioner is configured and disposed so that during operation, the wire loop, having passed through the toroidal core, runs into the gap and is thus initially guided in the gap and passes through the gap in the wire direction. In the pre-tensioned state, the wedge-shaped gap is so small at its narrowest point that the wire loop is initially prevented from sliding in the radial direction because in this state, the gap at its narrowest point is smaller than the wire diameter. As a result, the wire loop runs on through the gap in the wire direction and is tensioned. This being the case, the wire loop is pulled tighter around the toroidal core so that another turn is created. Due to the tightening of the wire loop, the radial tensioning force of the wire becomes increasingly strong in the direction of the apex of the gap. Once the wedge has been pre-tensioned and when the tensioning force is sufficiently strong, the wedge moves so as to oppose the pre-tensioning and thus makes the gap larger, and when the tensioning force is sufficiently strong the wire loop drops or slips though the gap floor in the radial direction and thus leaves the wire tensioner and is released from it. The wire loop is thus pulled onwards by the continuing driving action of the rotating wire belt.

Based on another aspect, the wire ejector is provided in the form of rotating means and is disposed so that during operation, the at least one rotating means grips a wire loop from the wire belt, moves the wire and thus reliably and easily ejects the wire loop. On ejection, the wire loop drops off the second transport roller. Furthermore, any further movement directed onto the second transport wheel is prevented. The wire loop then runs onwards into the wire tensioner. Based on one embodiment, the rotating means is a wheel having at least one driver or a star wheel or toothed wheel or a rotating toothed belt or a rotating chain having at least one outwardly extending cam or hook. During operation, the wire ejector is advantageously synchronised with the device so that with every revolution of the wire belt one of the preferably several rotating drivers, teeth, cams or hooks grips and thus moves a wire loop—namely the next one on the wire belt starting from the wire loop—so that this wire loop drops off the second transport roller.

Based on another aspect, the device further comprises at least one wire guiding means which is configured so that during operation, it guides the wire that has been released by the wire tensioner again past the top transport roller so that another wire loop is formed and the wire is not directed back onto the first transport wheel.

Based on another aspect, the device further comprises at least one wire guide plate parallel with the wire guiding plane, which at least partially overlaps the top transport roller and thus reliably prevents the loop from being directed onto the first transport wheel again and thus reliably forms another wire loop.

Examples of embodiments of the invention will be explained in more detail below with reference to the appended drawings. Of these:

Figure 6:
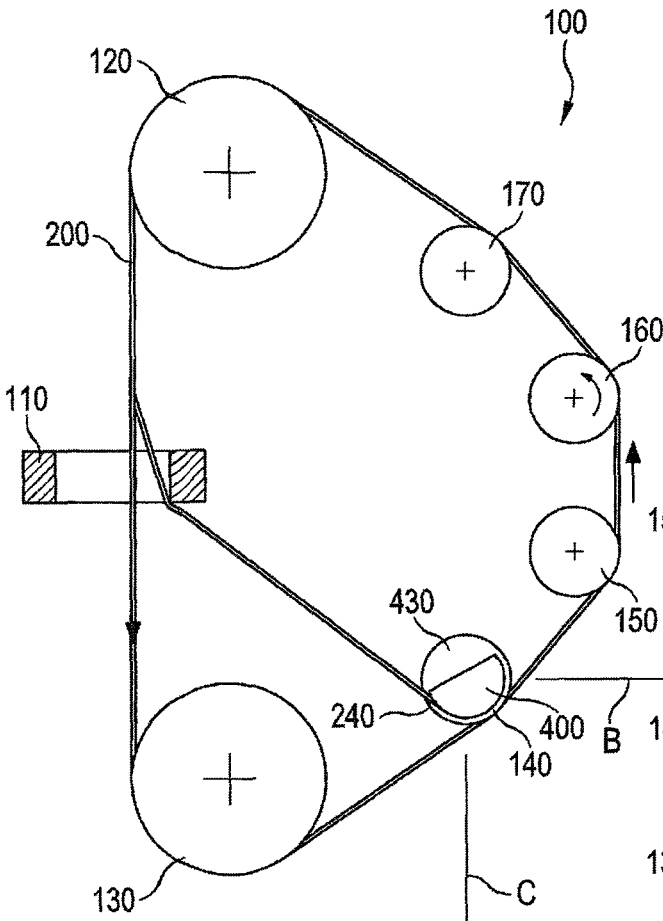
Figure 7:
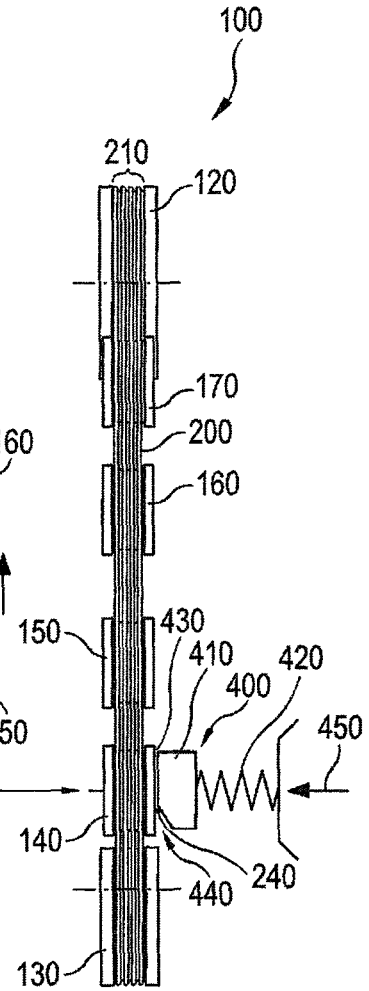
Figure 8:
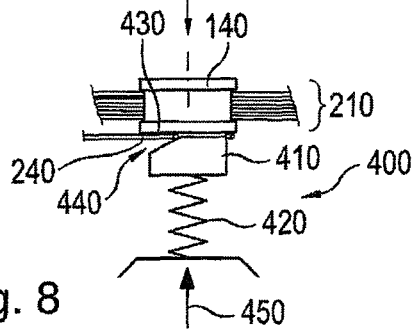
Figure 9:
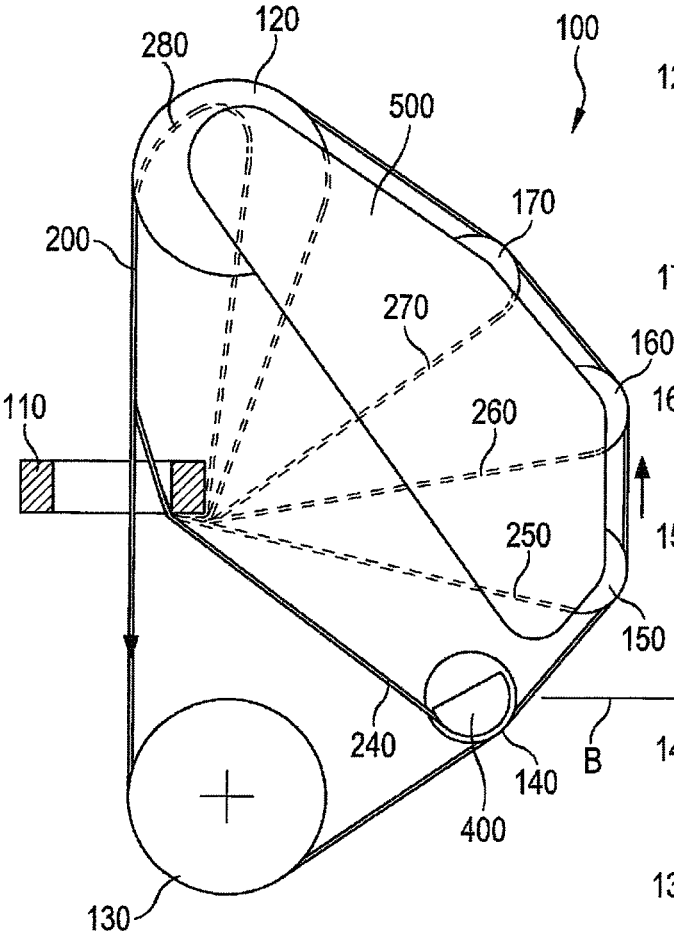
Figure 10:
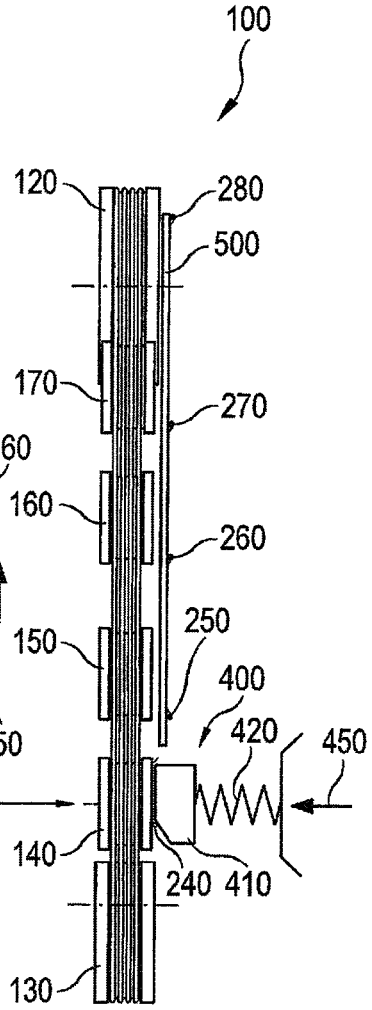

FIGS. 6 to 8 are rudimentary schematic diagrams of embodiments of the toroidal core winding device viewed from different perspectives, in which, for the sake of simplicity, the toroidal core retainer and the wire ejector amongst other things are not illustrated; and FIGS. 9 and 10 are rudimentary schematic diagrams of embodiments of the toroidal core winding device viewed from different perspectives, in which, for the sake of simplicity, the toroidal core retainer and the wire ejector amongst other things are not illustrated.

The toroidal core winding device 100 illustrated in FIGS. 1 to 4 has a toroidal core retainer (not illustrated) in which the toroidal core 110 to be wound is held and rotated during winding. Based on one embodiment, the toroidal core retainer is provided in the form of three pinch rollers which are disposed respectively at a distance of 120° from one another around the toroidal core and press against the toroidal core from outside and thus hold it in the desired position. At least one of the pinch rollers simultaneously drives the toroidal core and thus moves it in the desired rotation in order to apply the turns of the winding at the desired distance on the toroidal core.

Figure 1:
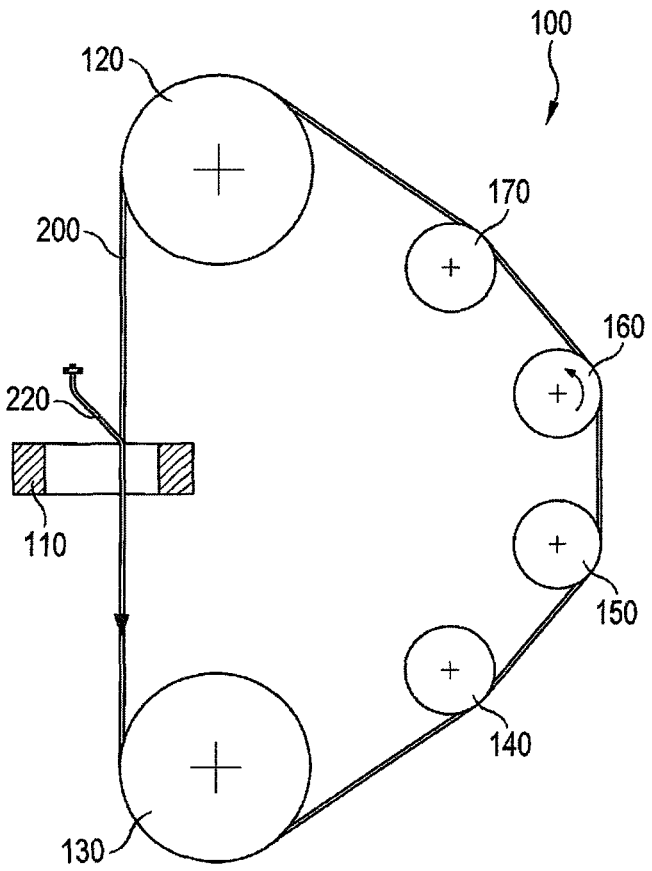
FIGS. 1 and 2 are rudimentary schematic diagrams of embodiments of the toroidal core winding device viewed from different perspectives, in which, for the sake of simplicity, the toroidal core retainer, the wire ejector and the wire tensioner amongst other things are not illustrated.

Instead of a magazine, the device has elements disposed in the wire guiding plane for guiding the wire and magazining the wire, in particular across the first and second transport rollers 120, 130 and, if provided, other auxiliary rollers 140, 150, 160, 170, together referred to as wire guiding rollers, which are disposed respectively on mutually parallel axes of rotation. In this respect, FIG. 1 illustrates an embodiment with auxiliary rollers and FIG. 2 an embodiment without auxiliary rollers. The rotation axis of the toroidal core preferably lies substantially in the wire guiding plane so that the rotation axes of the toroidal core and wire guiding rollers are preferably oriented perpendicular to one another.

Based on the embodiments illustrated in the drawings, the first transport roller constitutes the top transport roller 120 and is disposed above the toroidal core retainer 110. Accordingly, the second transport roller constituting the bottom transport roller 130 is disposed so that the wire 200 directed from the top to the bottom transport roller runs through the toroidal core to be wound disposed in the toroidal core retainer.

Figure 2:
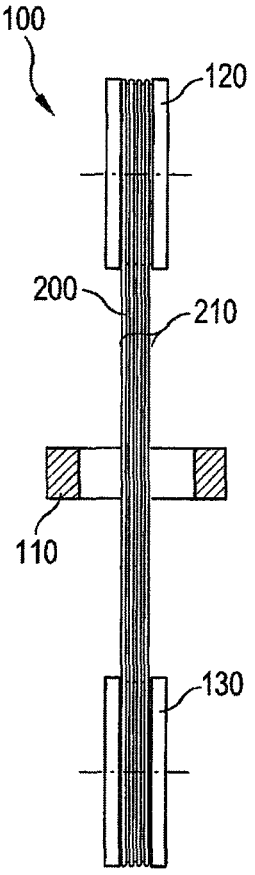

In view of the fact that the device does not have a magazine for guiding the wire and magazining the wire, a cable is directed firstly across the wire guiding rollers and through the toroidal core in such a way that the wire is then magazined as a wire belt in the device incorporating the toroidal core based on one embodiment. The cable is then appropriately tied or closed in some other way, for example, to form a closed loop and connected to the start of the (winding) wire. Alternatively and depending on the wire thickness used, the winding wire start may also be guided directly across the wire guiding rollers and through the toroidal core and then closed on reaching the starting point. The winding wire is drawn off a supply roller (not illustrated), for example, and then, driven by means of at least one of the wire guiding rollers—the at least one drive or traction roller—into the device, magazined onto the wire guiding rollers. In this manner, a sufficiently long piece of wire in the form of several circumferentially extending turns is then loaded into the device. The operation of magazining the winding wire is complete when the sufficiently long piece of wire has been wound onto the wire guiding rollers. The wire thus forms a wire belt 210 consisting of several turns, as illustrated in FIG. 2, for example. The individual turns preferably lie adjacent to one another on the wire guiding rollers. The wire belt thus forms a magazine-type wire supply on the roller system made up of the wire guiding rollers without the need for a conventional magazine. FIGS. 1 and 2 illustrate the process of magazining the wire belt through to completion.

Winding of the toroidal core can then start. To this end, a free end 220 of the wire is firstly secured, as indicated in FIG. 1. A free end of the wire is expediently secured to an appropriate fixing point of the device, for example to the toroidal core retainer, or may also be held by the machine operator during winding.

Figure 3:
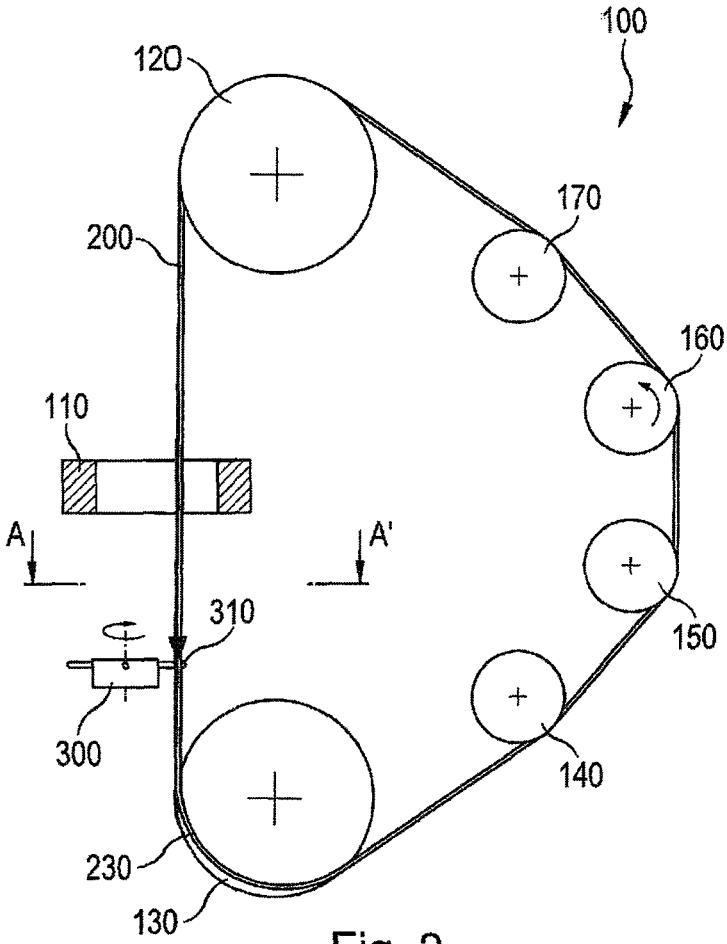
FIGS. 3 to 5 are rudimentary schematic diagrams of embodiments of the toroidal core winding device viewed from different perspectives, in which, for the sake of simplicity, the toroidal core retainer and the wire tensioner amongst other things are not illustrated.

To actually wind the toroidal core with the wire, the wire belt is then driven by the drive or traction roller 160 and displaced in rotation so that the wire belt runs across the first transport roller through the toroidal core to the second transport roller and then onwards, across the auxiliary rollers if provided, and back to the first transport roller, as illustrated in FIG. 3, for example. A turn of the wire belt is then firstly ejected from the second transport roller and forms a wire loop for winding the toroidal core.

Figure 4:
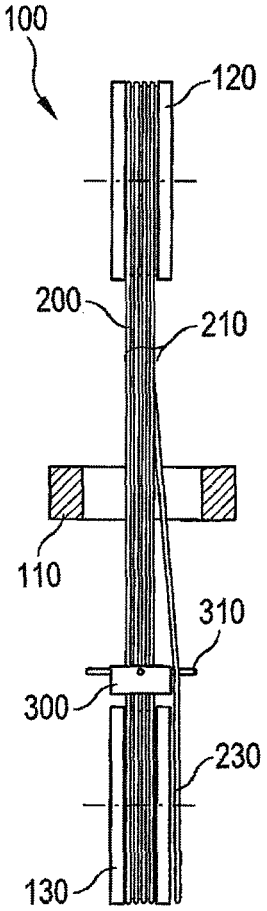
Figure 5:
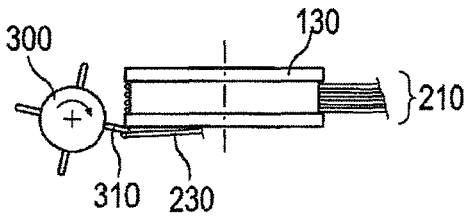

To this end, the wire ejector 300 is expediently disposed underneath the toroidal core 110 and in the vicinity of the bottom transport roller 130 as illustrated in FIGS. 3-5 and is configured during operation, in such a way that the portion 230 of the turn of the wire to be wound that will become a loop, having passed through the toroidal core, is moved sideways out of the wire guiding plane so that the wire loop drops off the second wire roller and does not run across the second transport roller but into the wire tensioner.

Based on one embodiment, the wire ejector is provided in the form of a star wheel or a wheel with at least one driver 310 and the wheel rotates in such a way that a tooth of the star wheel or a driver grips the portion 230 of the turn of the wire to be wound that will become a loop and moves it sideways out of the wire guiding plane. Alternative wire ejectors comprise rotating belts or chains with at least one outwardly extending driver, cam, hook or similar. FIG. 5 illustrates a detail of the device from a view into plane A-A' indicated in FIG. 3. FIG. 4 illustrates a detail of the device similar to that of FIG. 2 but with the wire ejector 300.

The wire loop then no longer runs across the second transport roller as illustrated in FIGS. 3 to 5 but on into the wire tensioner, the operating mode of which will be described in more detail with reference to FIGS. 6 to 8. The wire tensioner 400 firstly tensions the wire loop and then releases it. Based on one embodiment, the wire tensioner comprises a pre-tensioned, gap-forming wedge 410. This wedge together with an oppositely lying surface 430 of the device substantially parallel with the wire guiding plane forms a gap 440 into which the wire portion 240 runs. Due to the fact that the wire tensioner is stationary relative to the rotating wire belt and hence also the wire loop and the fact that the wire belt 210 continues to rotate on the rollers, the wire loop is tensed forming a new turn around the toroidal core and the wire loop is tightened. The tightening of the wire loop causes a radial force on the wire, amongst other things against the wedge apex in the gap. Based on one embodiment, the wedge or the oppositely lying surface is pre-tensioned, for example by means of a spring 420, and is mounted so that the wedge 420 and the oppositely lying surface 430 are pressed against one another by spring force and thus form a quasi-closed gap 440 or a gap, of which the slimmest end of the gap is smaller than the wire diameter so that the wire runs in the wire direction through the gap and is guided but does not slip through the gap in the radial direction. When a sufficiently strong force (greater than the resulting spring force) is expended on the wedge and the oppositely lying surface by the wire 240 disposed in the gap in the direction towards the wedge apex (corresponding to the narrow end of the gap), the wedge and the oppositely lying surface move so far apart from one another that the gap becomes wider or opens, allowing the wire to slip in the radial direction through the gap floor or narrow end of the gap. In this respect, the spring force is selected so that the wire loop is firstly tensioned, namely is tightened to the degree necessary for the winding operation but without the wire tearing. Once the predefined traction force is obtained on the wire, the wire loop is then pulled through the opening or widening gap. The opening of the gap as a function of the traction force on the wire, the wire diameter, etc., is expediently set up on the basis of the setting of the spring force (arrow 450) and the choice of steepness of the wedge, in other words the angle subtended by the wedge and oppositely lying surface. FIG. 6 in turn shows a side view of the device, as is the case with FIGS. 1 and 3 above. FIG. 7 is a view similar to that of FIGS. 2 and 4, but in FIG. 7 the line of sight is behind the toroidal core and therefore does not show the toroidal core but the auxiliary rollers 140, 150, 160, 170 and the wire tensioner 400 (arrow B). FIG. 8 illustrates a detail from FIG. 6 from above around the wire tensioner 400 (arrow C).

Based on one embodiment illustrated in FIGS. 9 and 10, once the wire loop has been tensioned and then released by the wire tensioner, the wire loop, guided by at least one wire guiding means, slides past the top transport roller 120. Based on another embodiment, the wire guiding means comprises at least one wire guide plate 500 parallel with the wire guiding plane, which at least partially overlaps the top transport roller and the auxiliary rollers, if provided. The movement of the freed wire loop, having been released, through the wire tensioner is illustrated as a function of time by the wire portions 250, 260, 270, 280 indicated by broken lines. Accordingly, the wire loop is not directed back onto the top transport roller but forms a so-called loose phase, in particular at the position of the wire portion 280, during the subsequent course of which and after passing through the toroidal core the process of winding of the wire continues based on another ejection or movement of the wire loop by the wire ejector as described above. This operation is repeated until the desired number of wire turns have been applied to the toroidal core.

Based on one embodiment, the winding method may be summarised as follows. The toroidal core is guided in the toroidal core retainer. The winding wire is magazined by the toroidal core to form a so-called wire belt on the wire guide oriented perpendicular to the toroidal core. A wire end is secured. A wire loop taken from the wire belt is ejected from the wire guide in a so-called loose phase with the aid of the wire ejector, for example a star wheel, ejector wheel or some other ejector means. The wire is then tensioned in the wire tensioner and at the same time pulled tight on the toroidal core. The wire loop released by the wire tensioner is transferred past the wire guide to the loose phase again and the next process of winding a turn begins.

Within the meaning of the invention, the term toroidal core also includes tubular cores or cores with a specific opening geometry and relates in particular to such toroidal cores having a small internal diameter or cores with an angled opening geometry as well as tubular cores which, because of their dimensions, cannot be wound using a conventional device for winding toroidal core coils because the magazine cannot be fed through the toroidal core opening due to the amount of space needed for the magazine. However, the embodiments described here are also suitable for winding other toroidal cores or cores with any other opening and also those having larger internal diameters, and enable a simple and convenient winding operation.

Within the meaning of the invention, the term wire or winding wire also includes all other materials by means of which toroidal cores or similar objects can be wound in practical terms as proposed by the invention.

Other advantageous embodiments and variants lie within the reach of the person skilled in the art on the basis of the embodiments described as examples here and should be understood by the latter as forming part of the invention.

The invention claimed is:

1. A device for winding toroidal cores without using a magazine, having a toroidal core retainer and elements used to guide a wire and magazine the wire disposed substantially in a wire guiding plane, comprising:

a first transport roller and a second transport roller disposed in such a way relative to the toroidal core retainer that the wire to be magazined and wound on the transport rollers in the wire guiding plane can be guided between the first and second transport roller through a toroidal core in the toroidal core retainer;

a wire ejector disposed adjacent to the second transport roller; and a wire tensioner;

wherein the wire ejector is configured so that during operation, a loop of the wire to be wound, having passed through the toroidal core, is moved sideways out of the wire guiding plane adjacent to the second transport roller and the wire then runs into the wire tensioner; and wherein the wire tensioner is configured to firstly tension the wire loop and then release it again for continuing winding.

2. The device as claimed in claim 1, wherein the elements used to guide the wire and magazine the wire further comprise at least one auxiliary roller, and at least one of the transport rollers or auxiliary rollers is provided in the form of a drive roller or traction roller.

3. The device as claimed in claim 2, wherein the transport or auxiliary rollers are configured so that during operation, the wire forms a closed wire belt during magazining.

4. The device as claimed in claim 1, wherein the wire tensioner comprises a pre-tensioned, gap-forming wedge, and the wire tensioner is configured and disposed so that during operation, the wire loop runs into the gap, is tensioned in the gap and, when a predefined traction force is obtained on the wire, the wire loop is pulled though a gap floor.

5. The device as claimed in claim 1, wherein the wire ejector is provided in the form of a rotating means and is disposed so that during operation, the rotating means grips and moves the wire sideways.

6. The device as claimed in claim 1, further comprising at least one wire guiding means, and the wire guiding means is configured so that during operation, the wire loop that has been released by the wire tensioner again is guided past the first transport roller.

7. The device as claimed in claim 6, wherein the wire guiding means comprises at least one wire guide plate parallel with the wire guiding plane, which at least partially overlaps the first transport roller.

8. A method for winding a toroidal core with a wire, without using a magazine, with the aid of a winding device comprising a toroidal core retainer and elements used for guiding the wire and magazining the wire disposed substantially in a wire guiding plane, comprising a first and a second transport roller, a wire ejector and a wire tensioner, the method comprising:

a. guiding a wire belt comprising a single-piece wire in the wire guiding plane across the first transport roller through the toroidal core rotating in the toroidal core retainer substantially perpendicular to the wire belt and then across the second transport roller and back to the first transport roller;

b. forming a loop of wire from the wire belt adjacent to the first transport roller;

c. passing the wire loop through the toroidal core and moving it out of the wire guiding plane adjacent to the second transport roller by means of the wire ejector;

d. tensioning the wire loop in the wire tensioner;

e. releasing the wire loop by means of the wire tensioner.

9. The method as claimed in claim 8, wherein:

the first transport roller and the second transport roller are disposed in such a way relative to the toroidal core retainer that the wire to be magazined and wound on the transport rollers in the wire guiding plane can be guided between the first and second transport roller through the toroidal core;

the wire ejector is disposed adjacent to the second transport roller;

moving the wire loop out of the wire guiding plane comprises moving the wire loop sideways out of the wire guiding plane, and the wire then runs into the wire tensioner; and the wire tensioner is configured to firstly tension the wire loop and then release it again for continuing winding.

10. The method as claimed in claim 8, wherein the wire belt is magazined from a wire supply onto the transport rollers.

11. The method as claimed in claim 8, wherein at the start of a winding process, one end of the wire is magazined as the wire belt is secured.

12. The method as claimed in claim 8, wherein steps b. to. e are repeated in order to apply a desired number of turns of the wire to the toroidal core.

13. The method as claimed in claim 8, wherein the elements used to guide the wire and magazine the wire further comprise at least one auxiliary roller, and at least one of the transport or auxiliary rollers is provided in the form of a drive roller or traction roller.

14. The method as claimed in claim 8, wherein the transport or auxiliary rollers are configured so that during operation, the wire forms a closed wire belt during magazining.

15. The method as claimed in claim 8, wherein the wire tensioner comprises a pre-tensioned, gap-forming wedge, and the wire tensioner is configured and disposed so that during operation, the wire loop runs into the gap, is tensioned in the gap and, when a predefined traction force is obtained on the wire, the wire loop is pulled though a gap floor.

16. The method as claimed in claim 8, wherein the wire ejector is provided in the form of a rotating means and the method comprises gripping and moving the wire sideways with the rotating means.

17. The method as claimed in claim 8, further comprising again guiding the wire loop that has been released by the wire tensioner past the first transport roller with a wire guiding means.

18. The method as claimed in claim 17, wherein the wire guiding means comprises at least one wire guide plate parallel with the wire guiding plane, which at least partially overlaps the first transport roller.

* * * * *